United States Patent [19]

Heitmann

[11] Patent Number: 4,732,164

[45] Date of Patent: Mar. 22, 1988

[54] METHOD OF AND APPARATUS FOR MAKING A CONTINUOUS FILLER OF TOBACCO OR THE LIKE

[75] Inventor: Uwe Heitmann, Hamburg, Fed. Rep. of Germany

[73] Assignee: Körber AG, Hamburg, Fed. Rep. of Germany

[21] Appl. No.: 899,349

[22] Filed: Aug. 22, 1986

[30] Foreign Application Priority Data

Aug. 22, 1985 [DE] Fed. Rep. of Germany ..... 3530022

[51] Int. Cl.[4] ..... A24C 5/18

[52] U.S. Cl. ..... 131/84.3; 131/84.4

[58] Field of Search ..... 131/84.1, 84.3, 84.4

[56] References Cited

U.S. PATENT DOCUMENTS

| | | | |
|---|---|---|---|
| 3,019,793 | 2/1962 | Labbë131 | 84.3/ |
| 4,207,907 | 6/1980 | Dyett | 131/84.3 |
| 4,461,307 | 7/1984 | Hoffmann | 131/84.3 |
| 4,593,704 | 6/1986 | Wahle et al. | 131/84.3 |
| 4,600,020 | 7/1986 | Mattei et al. | 131/84.4 |

FOREIGN PATENT DOCUMENTS

| | | |
|---|---|---|
| 673628 | 3/1939 | Fed. Rep. of Germany . |
| 2521414 | 11/1976 | Fed. Rep. of Germany . |

*Primary Examiner*—V. Millin

*Attorney, Agent, or Firm*—Peter K. Kontler

[57] ABSTRACT

A stream of tobacco particles which is built at the underside of the lower reach of an endless foraminous belt conveyor is trimmed to remove the surplus, and the resulting filler is draped into a web of cigarette paper while advancing through a wrapping mechanism. In order to reduce friction in the wrapping mechanism, the stream is shaped, at least in part, to assume a cross-sectional outline conforming to that of the wrapped filler. Such cross-sectional outline can be imparted by the conveyor and/or by the trimming device. The web of cigarette paper is also shaped on its way toward the wrapping mechanism to assume the shape of a trough.

26 Claims, 12 Drawing Figures

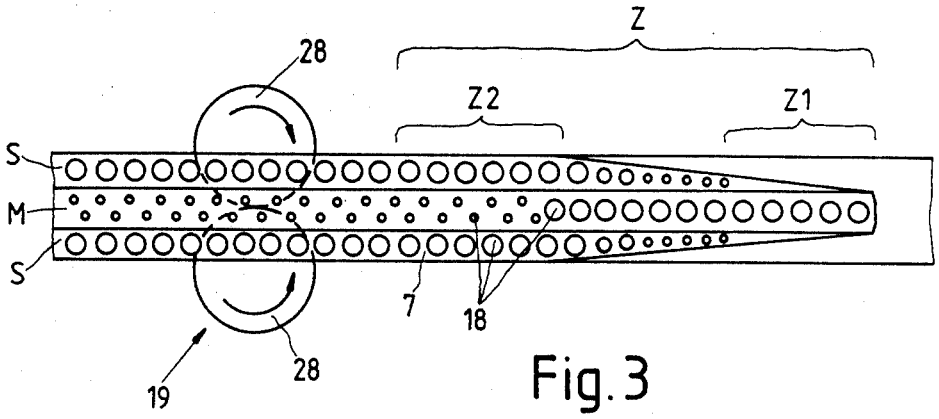
Fig. 3
Fig. 4
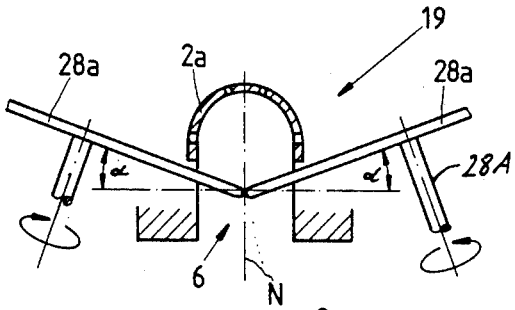
Fig. 5
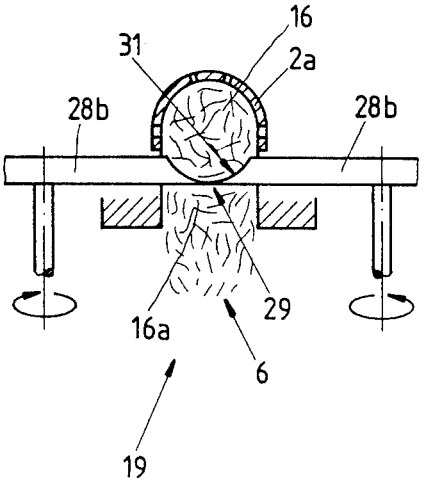
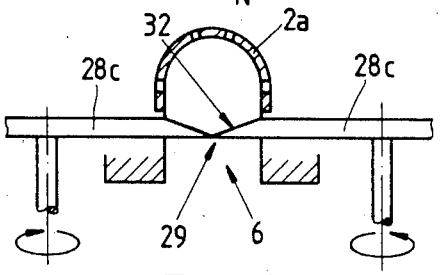
Fig. 6

METHOD OF AND APPARATUS FOR MAKING A CONTINUOUS FILLER OF TOBACCO OR THE LIKE

BACKGROUND OF THE INVENTION

The present invention relates to a method of and to an apparatus for making a continuous filler of fibrous material, particularly a tobacco filler which is ready to be draped into a web of cigarette paper or the like to form with the web a continuous tobacco-containing rod.

The invention will be described with reference to the making of a filler which can be converted into a portion of a cigarette rod. However, the method and apparatus of the present invention can be utilized with equal or with similar advantage in connection with the making of other types of rod-shaped articles of the tobacco processing industry such as cigarillos, cigars and filter rod section.

Modern cigarette making machines are equipped with distributors which deliver a continuous shower of fibrous material (such as fragments of tobacco leaves, fragments of reconstituted tobacco and/or fragments of substitute tobacco) onto a driven endless air-permeable belt conveyor travelling along a suction chamber so that the conveyor attracts the fragments and converts successive increments of the shower into a continuous stream containing a surplus of fibrous material. The surplus is removed by a suitable trimming or equalizing device so that the stream is converted into a substantially rod-shaped filler which is draped into cigarette paper or other suitable wrapping material in a so-called sizing part. The resulting cigarette rod is severed at predetermined intervals so as to yield a series of plain cigarettes of unit length or multiple unit length. The cigarettes can be advanced to storage, to a packing machine or to a filter tipping machine. Cigarette rod making machines of the above outlined type are manufactured by the assignee of the present application and are known as PROTOS.

That stretch or reach of the endless air-permeable conveyor which intercepts the shower of fibrous material is normally flat so that the stream which grows on the conveyor has a flat side or surface abutting the adjacent reach of the conveyor. The intercepting reach of the conveyor is normally located at the bottom of a tobacco channel wherein the stream must travel along stationary walls with attendant generation of friction which can interfere with predictable transport of the stream toward the surplus removing station. It has been found that the friction between the stationary walls of the tobacco channel and the adjacent sides or surfaces of the tobacco stream can interfere with predictable transport of the stream, even if the transporting or conveying unit including the air-permeable conveyor has a suction chamber which attracts the stream to one side of the belt conveyor with a substantial force. Additional problems arise when the thus formed stream enters the sizing part wherein the stream having a polygonal cross-sectional outline must be converted into a rod-like filler having a circular or substantially circular cross-sectional outline. As a rule, the stream which advances beyond the trimming or equalizing station has a rectangular or square cross-sectional outline. This means that the customary garniture tape, which is an element of the sizing part and advances the trimmed or equalized stream and the web of wrapping material through the draping station, must subject the trimmed stream to pronounced deforming stresses in order to eliminate the corners between the sides of the polygon during conversion of the freshly trimmed stream into a rod-like filler. Friction between the sizing part and the freshly trimmed stream, as well as between the sizing part and the web of cigarette paper is often sufficiently pronounced to entail a jamming at the inlet to the sizing part with resulting substantial losses in output. A modern cigarette maker turns out up to and in excess of 8000 plain cigarettes per minute.

The trimming or equalizing device of a conventional cigarette rod making machine normally comprises two rotary disc-shaped knives which are disposed at a variable distance from the stream-carrying reach of the air-permeable conveyor. The peripheries of the knives contact each other in a central longitudinal symmetry plane of the path which is defined by the stream-attracting and advancing reach of the belt conveyor. The plane of the knives is normal to the aforementioned symmetry lane and is parallel to the plane of the normally flat stream-attracting reach of the belt conveyor. The knives cooperate with the lateral walls of the tobacco channel and with the flat reach of the belt conveyor to impart to the trimmed stream a substantially square or a substantially rectangular cross-sectional outline. In other words, the outline of the freshly trimmed stream deviates considerably from the outline of the rod-like filler which issues from the sizing part of the cigarette rod making machine. Even minor accumulations of fibrous material and/or wrapping material at the inlet of the sizing part necessitate long-lasting interruptions of operation of the cigarette rod-making machine. This often necessitates an interruption of the operation of other machine or machines which are operatively connected with the cigarette rod making machine, such as a packing machine, a filter tipping machine and a filter rod making machine.

OBJECTS AND SUMMARY OF THE INVENTION

An object of the invention is to provide a novel and improved method of forming a trimmed stream of fibrous material in such a way that the cross-sectional outline of the trimmed stream more closely resembles the cross-sectional outline of the filler of a cigarette rod or another rod-shaped product of the tobacco processing industry.

Another object of the invention is to provide a novel and improved method of shaping the stream of tobacco or other fibrous material on its way toward, past and beyond the surplus removing station.

A further object of the invention is to provide a method which renders it possible to densify selected portions of a continuous stream of fibrous material while simultaneously ensuring that the cross-sectional outline of the stream more closely resembles the cross sectional outline of an ideal filler.

An additional object of the invention is to provide a simple method of converting a continuous shower of fragments of tobacco leaves or other fibrous material of the tobacco processing industry into a continous rod-like filler which is ready to be subdivided into sections of unit length or multiple unit length.

Still another object of the invention is to provide a method which reduces the likelihood of accumulation of fibrous material and/or wrapping material at the inlet of the sizing part in a cigarette rod making machine.

A further object of the invention is to provide a method which reduces the likelihood of excessive frictional engagement between the trimmed stream and/or the web of wrapping material on the one hand, and the components of the sizing part in a cigarette rod making machine on the other hand.

A further object of the invention is to provide a novel and improved apparatus which can be utilized for the practice of the above outlined method.

A further object of the invention is to provide the apparatus with novel and improved means for shaping the stream of fibrous material on its way toward, past and beyond the surplus removing station.

An additional object of the invention is to provide the apparatus with novel and improved means for removing the surplus of fibrous material.

Another object of the invention is to provide the apparatus with novel and improved means for guiding the air-permeable belt conveyor of the transporting unit which is utilized to accumulate fibrous material into a stream and to advance the stream past the trimming station and on to the sizing part of a cigarette rod making machine or the like.

Another object of the invention is to provide an apparatus wherein the cross-sectional outline of the stream which advances beyond the trimming station closely or reasonably closely resembles the cross-sectional outline of the rod issuing from the sizing part.

An additional object of the invention is to provide an apparatus wherein the friction between the constituents of a cigarette rod and the sizing part is a small fraction of friction in a conventional apparatus.

A further object of the invention is to provide a cigarette rod making machine which embodies the above outlined apparatus.

One feature of the present invention resides in the provision of a method of making a continuous filler of fibrous material, particularly a tobacco filler which has a predetermined cross-sectional outline. The method comprises the steps of feeding fibrous material into a stream-growing first portion of an elongated path to build a continuous stream which contains a surplus or excess of fibrous material, advancing the stream longitudinally along the path, removing the surplus from the stream in a second portion of the path, shaping the stream in the course of at least one of the feeding, advancing and removing steps so as to provide the stream with a cross-sectional outline a portion at least of which matches or resembles the corresponding portion of the predetermined cross-sectional outline, and preserving such portion of the cross-sectional outline of the stream at least until after completion of the removing step.

The advancing step preferably includes attracting the fibrous material and the stream to one side of an air-permeable endless conveyor and establishing a pressure differential between the one side and the other side of the conveyor so that the fibrous material of the growing and fully grown stream is attracted to and advances with the one side of the conveyor. The shaping step of such method preferably includes imparting to the one side of the conveyor a cross-sectional outline which is complementary to the aforementioned portion of the cross-sectional outline of the stream.

The imparting step can include giving to the one side of the conveyor the shape of an elongated channel having a longitudinally extending central section and two longitudinally extending lateral sections which flank the central section. The feeding step of such method can include attracting fibrous material primarily or exclusively to the central section in a first region of the first portion of the elongated path and attracting fibrous material to all of the sections in a second region of the first portion of the elongated path downstream of the first region.

The shaping step preferably includes or consists of removing the surplus from successive increments of the stream in such a way that the trimmed increments of the stream define the aforementioned portion of the cross-sectional outline of the stream. Such shaping step can include mechanically influencing the stream in the course of the surplus removing step.

The method can further comprise the steps of advancing a continuous web of wrapping material along a third portion of the elongated path downstream of the second portion, imparting to the web a cross-sectional outline which is complementary to the adjacent portion of the outline of the filler in the third portion of the path, and draping the thus deformed web around the filler.

The method can further comprise the steps of densifying spaced-apart portions of the stream not later than in the course of the surplus removing step. The densification can be carried out pneumatically and/or mechanically.

Another feature of the invention resides in the provision of an apparatus for making a continuous filler of fibrous material, particularly a tobacco filler, which has a predetermined cross-sectional outline (normally a substantially circular cross-sectional outline). The apparatus comprises a conveying or transporting unit defining an elongated path, a feeding unit which serves to admit fibrous material into a first portion of the elongated path so as to build on the conveying unit a continuous stream which contains a surplus of fibrous material and advances longitudinally along the path, a trimming or equalizing unit for removing the surplus from the advancing stream in a second portion of the path, and shaping means provided in the region of at least one of the units and having means for providing the stream with a cross-sectional outline at least a portion of which matches or resembles the corresponding portion of the predetermined cross-sectional outline.

The stream discharging end of the conveying unit is located downstream of the second portion of the elongated path, and the improved apparatus preferably further comprises means for preserving the aforementioned portion of the cross-sectional outline of the stream intermediate the shaping means and the stream discharging end of the conveying unit.

The shaping means is or can be disposed in the region of the conveying unit. In accordance with a presently preferred embodiment of the apparatus, the shaping means forms part of at least one of the feeding, conveying and trimming units.

If the shaping means includes a portion of the conveying unit, such portion of the conveying unit can comprise a deformable endless conveyor for the stream of fibrous material. The shaping means preferably further comprises means for deforming the conveyor so as to impart to the conveyor and outline which is complementary to the aforementioned portion of the cross-sectional outline of the stream. The deforming means is or can be adjacent the first portion of the elongated path. The conveyor is preferably permeable to air and has a first side defining the elongated path and a second side opposite the first side. The conveyor includes a median or central section and two lateral sections which flank the median section. The conveying unit embodying such air-permeable conveyor further comprises means for reducing the pressure at the second side of the conveyor along the median section of the conveyor in a predetermined (upstream) region of the first portion of the elongated path so as to attract fibrous material exclusively or primarily to the median section, and means for reducing the pressure at the second side of the conveyor along the median section as well as along the lateral sections in a second region of the first portion of the path downstream of the predetermined region so as to attract fibrous material across the major part at least or across the full width of the first side of the conveyor.

The deforming means for the air-permeable conveyor can include a substantially channel-shaped member having a concave guide surface and at least one suction chamber in the concave surface. The suction chamber or chambers constitute or form part of the aforementioned pressure reducing means. The air-permeable conveyor has an elongated reach with a convex first side which is adjacent the guide surface of the channel-shaped member and a concave second side which is adjacent the path. The stream is attracted to the concave side of the elongated reach of the air-permeable conveyor. The suction chamber or chambers include a first portion which is disposed in the aforementioned upstream region of the first portion of the path adjacent the median section of the reach, and a second portion which is disposed downstream of the upstream region of the first portion of the path and is adjacent the median section as well as the lateral sections of the reach. The second portion of the suction chamber is preferably configurated to increase the pressure differential between the opposite sides of the lateral sections in the direction of travel of the stream from the predetermined or upstream region of the first portion of the elongated path. The suction chamber or chambers and the associated suction generating device or devices can be said to constitute pneumatic means for attracting fibrous material to the median portion of the air-permeable conveyor. Such pneumatic means preferably includes means for attracting fibrous material to the median portion with a greater first force in the upstream region of the first portion of the path and with a lesser second force downstream of the predetermined or upstream region. The pneumatic means for attracting fibrous material to the lateral sections of the conveyor can be designed to attract fibrous material with an increasing force downstream of the predetermined or upstream region of the first portion of the path. The force with which fibrous material is attracted to the median section of the endless belt conveyor can be selected in such a way that it decreases in the direction of travel of the stream-carrying or attracting reach of the conveyor. This renders it possible to ensure more uniform distribution of fibrous material across the full width of the belt conveyor.

The shaping means can include a portion which forms part of the trimming unit. It such apparatus, the trimming unit can comprise at least one severing member which is arranged to remove the surplus from a predetermined side of the stream and to thereby impart to the predetermined side an outline which matches or resembles the corresponding portion of the predetermined outline. The trimming unit can comprise two rotary severing members which are disposed at opposite sides of and make predetermined angles (for example, relatively large acute angles) with a central longitudinal symmetry plane of the path. Each severing member can include a circumferentially extending cutting edge and a stream-shaping surface which is adjacent the cutting edge. Each shaping surface can have a substantially conical outline.

The apparatus can further comprise means for densifying spaced-apart portions of the stream. Such densifying means can be mounted adjacent the second portion of the path, i.e., in the region of the trimming or equalizing unit. The densifying means can include means for pneumatically and/or mechanically condensing longitudinally spaced-apart portions of the running stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a fragmentary developed bottom plan view of the tobacco channel in the apparatus of FIG. 1;

FIG. 4 is an enlarged transverse sectional view of the apparatus at the trimming station, showing a first embodiment of the surplus removing unit;

FIG. 5 is a similar view but showing a second surplus removing unit;

FIG. 6 is a similar view but showing a third surplus removing unit;

DESCRIPTION OF THE PREFERRED EMBODIMENTS

Figure 1:
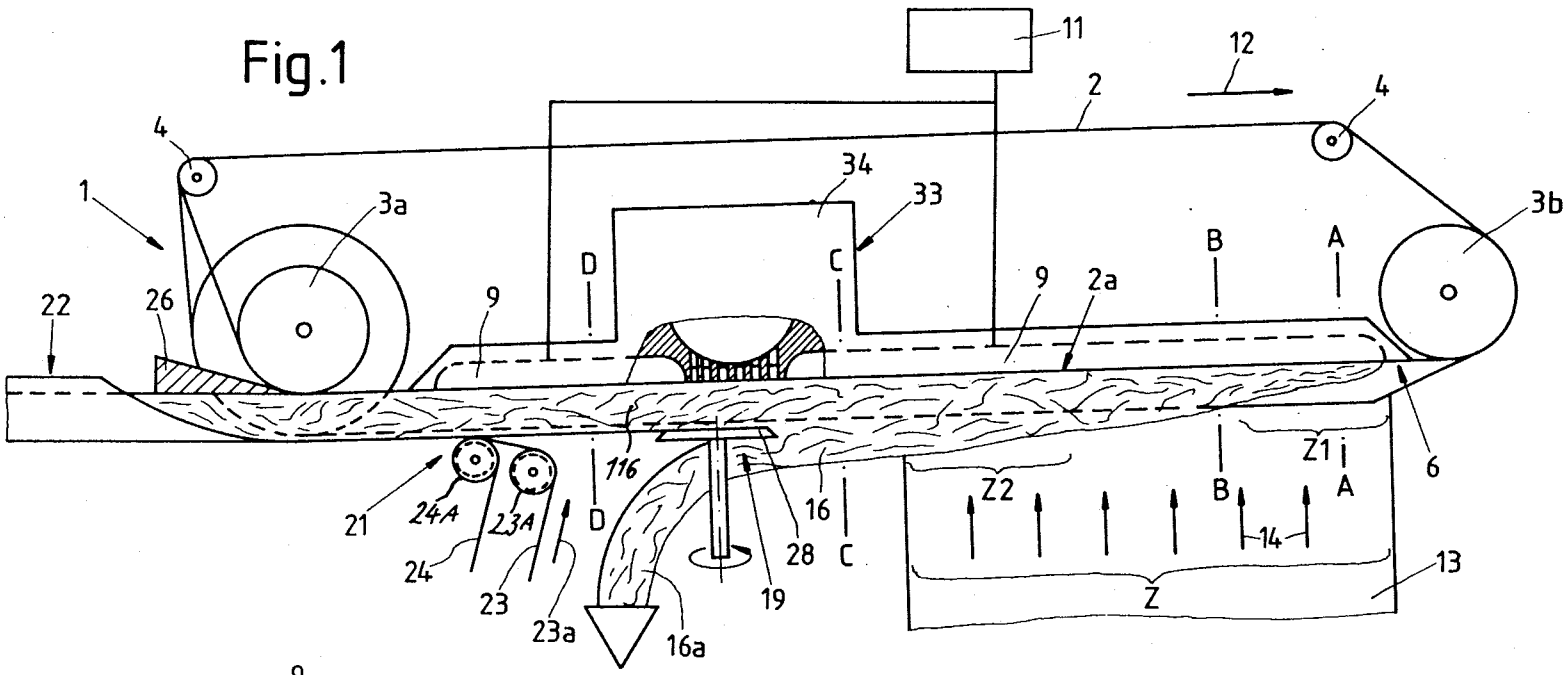
FIG. 1 is a fragmentary schematic partly elevational and partly sectional view of an apparatus which embodies one form of the present invention.

FIG. 1 shows a portion of a cigarette rod making machine which embodies the improved apparatus. The apparatus comprises a conveying or transporting unit 1 for fibrous material which is supplied by a feeding unit 13. The conveying unit 1 comprises a deformable endless air-permeable belt conveyor 2 which is trained over a front pulley 3*a*, over a rear pulley 3*b* and over several deflecting rolls 4 and is driven in the direction which is indicated by arrow 12. The belt conveyor 2 can be perforated or it can be made of a foraminous textile material. The lower reach or stretch 2*a* of the conveyor 2 is elongated and its underside is adjacent an elongated horizontal or nearly horizontal path for a stream 16 of fibrous material which is supplied by the feeding unit 13 in directions indicated by arrows 14. The lower reach 2a advances in a stationary part 6 of the conveying unit 1. Such part constitutes a means for deforming the lower reach 2a in a manner as shown in FIGS. 2A–2D and includes a channel-shaped member having a bottom wall 7 which is permeable to air and has a concave underside complementary to the convex upper side of the lower reach 2a. The channel-shaped member 6 extends all the way from the pulley 3b to, or close to, the pulley 3a. The upper portion 8 of the channel-shaped member 6 defines several suction chambers 9, 17 which are adjacent the upper or outer side of the bottom wall 7 and extend along predetermined portions of the elongated path for the continuous stream 16 of fibrous material. The suction chamber 9 is connected with a suitable suction generating device 11, for example, with the intake of a suction fan.

The feeding unit 13 constitutes one element of a distributor or hopper which, in turn, forms part of a cigarette rod making machine, for example, a machine known as PROTOS which is manufactured by the assignee of the present application. The reference character Z denotes that (first) portion of the elongated path wherein the shower of fibrous material which is delivered in the direction of the arrows 14 is converted into a fully grown stream 16 which is attracted to the concave underside of the lower reach 2a and advances with it in the direction of the arrow 12 toward and beyond a trimming or equalizing unit 19 which serves to remove the surplus 16a so that the remainder of the stream 16 constitutes a continuous filler 116 which is ready to be draped into a web 23 of cigarette paper or other suitable wrapping material.

The configuration and locations of the suction chambers 9 and 17 are shown in detail in FIGS. 2A–2D. The bottom wall 7 of the channel-shaped member 6 is U-shaped and bridges the stationary sidewalls 6a flanking the path for the stream 16. The arrangement is such that the bottom wall 7 deforms the lower reach 2a so as to impart to the underside or inner side of the lower reach 2a a configuration which corresponds to the desired or ideal configuration of the corresponding (upper) portion of the trimmed stream or filler 116.

The centrally located suction chamber 9 extends substantially along the full length of the channel-shaped member 6 and is adjacent the convex upper side of the bottom wall 7. The width of the suction chamber 9 is selected in such a way that it establishes a pressure differential only between the longitudinally extending central or median section M of the convex upper side of the lower reach 2a and the corresponding portion of the concave underside of such reach. The pressure differential at the opposite sides of the two lateral sections S of the lower reach 2a which flank the median section M is established by the suction chambers 17 which begin at the junction between the upstream region Z1 and the downstream region Z2 of the first portion Z (stream building zone) of the elongated path which is defined by the lower reach 2a of the endless belt conveyor 2. This means that fibers which are caused to rise in the upstream region Z1 of the path portion Z are attracted only to the underside of the median section M of the lower reach 2a, and fibers which rise in the downstream region Z2 of the portion Z are attracted not only to the median section M but also to the two lateral sections S of the lower reach 2a. The suction chambers 17 extend from the downstream end of the region Z1 and all the way, or nearly all the way, to the downstream end of the channel-shaped member 6.

Figure 2A:
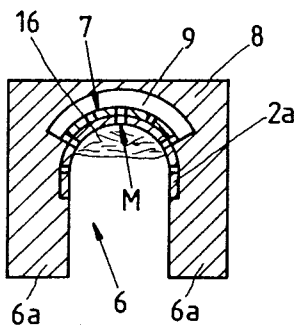
FIG. 2A is an enlarged transverse sectional view taken along the line A—A of FIG. 1.
Figure 2B:
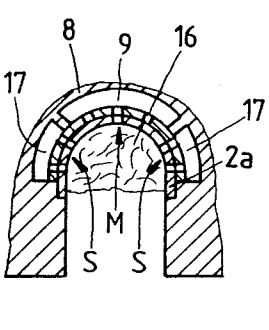
FIG. 2B is an enlarged transverse sectional view taken along the line B—B of FIG. 1.
Figure 2C:
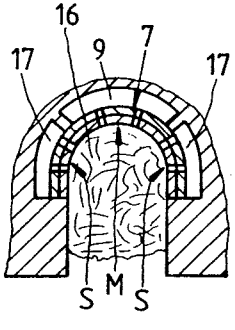
FIG. 2C is an enlarged sectional view taken along the line C—C of FIG. 1.
Figure 2D:
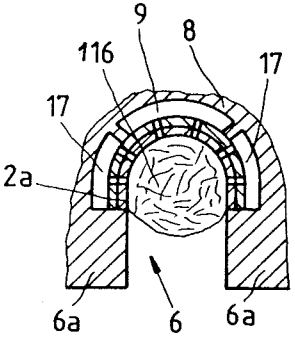
FIG. 2D is an enlarged sectional view taken along the line D—D of FIG. 1.
Figure 7:
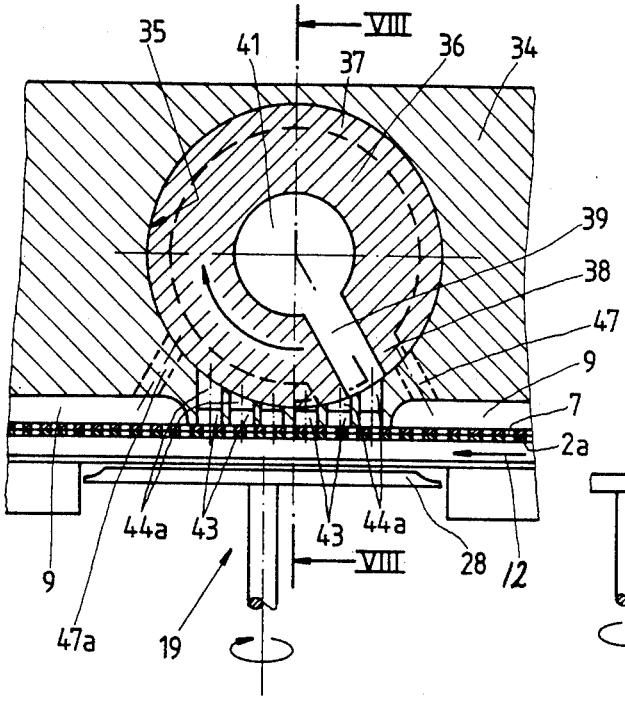
FIG. 7 is an enlarged longitudinal vertical sectional view of a detail at the trimming station of FIG. 1, showing the means for densifying selected portions of the stream.
Figure 8:
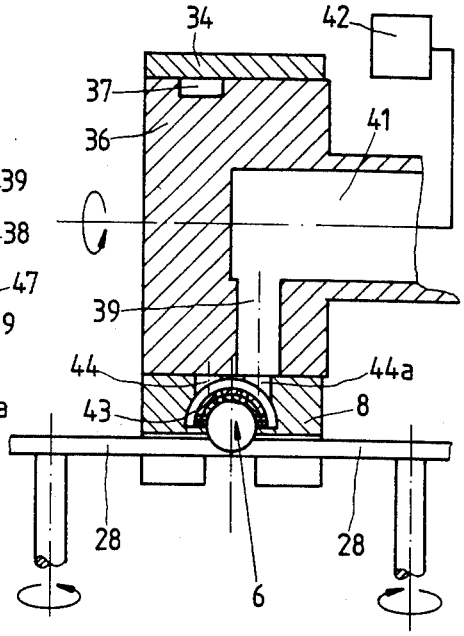
FIG. 8 is a transverse vertical sectional view as seen in the direction of arrows from the line VIII—VIII in FIG. 7.
Figure 9:
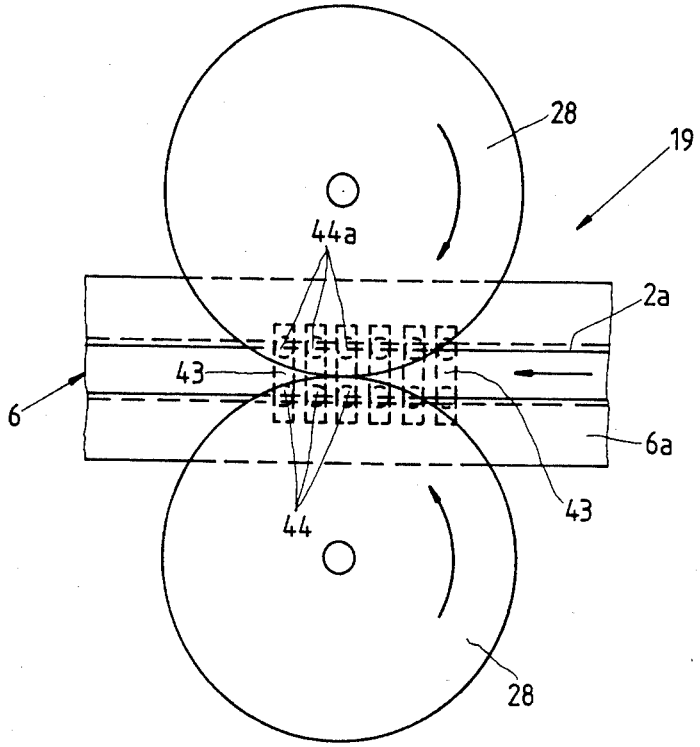
FIG. 9 is a bottom plan view of the trimming station which is shown in FIGS. 7 and 8.

FIGS. 2B, 2C and 2D show that the width of the lateral or additional suction chambers 17 (as considered in the circumferential direction of the stream 16) increases in a direction from the region Z1 toward the stream discharging end 21 of the lower reach 2a of the belt conveyor 2. Consequently, the width of those portions of the growing and fully grown stream 16 which are positively attracted to the corresponding portions of the lower reach 2a also increases in the direction of the arrow 12. The arrangement is or can be such that the width of the suction chambers 17 increases in the second or downstream region Z2 of the portion Z of the elongated path and that such width thereupon remains constant or substantially constant all the way from the downstream end of the region Z2 to the stream discharging end 21 of the conveyor 2.

FIG. 3 shows the stream building station from below. The dimensions of the parts which are shown in FIG. 3 are not drawn to scale. This Figure is merely intended to indicate how the magnitude of forces which attract fibrous material to the concave underside of the lower reach 2a of the belt conveyor 2 varies in the direction of the arrow 12. As shown, the bottom wall 7 has relatively large suction openings or ports 18 only in the region Z1 in line with the median or central section M of the lower reach 2a. This ensures that fibrous material can readily rise all the way to the central section M and does not adhere to the adjacent lateral sections S of the lower reach 2a. Such distribution of ports 18 in the region Z1 enhances the homogeneity of the stream 16 which is being built in the first portion Z of the elongated path defined by the lower reach 2a of the conveyor 2. The rate at which the ports 18 draw fibrous material against the median section M of that part of the lower reach 2a which advances through the region Z1 can be constant.

FIG. 3 further shows that fibrous material is attracted not only to the median section M but also to the lateral sections S of the lower reach 2a while successive increments of the lower reach advance beyond the region Z1 and along the region Z2 as well as along the remaining portion of the elongated path at the concave underside of the lower reach 2a. The combined cross-sectional area of suction ports 18 which register with the lateral sections S of the lower reach 2a in the region Z2 of the first portion Z of the elongated path preferably increases in the direction of the arrow 12 so that the fibrous material which is attracted to the lateral sections S adheres to the respective lateral sections with a progressively increasing force. This also contributes to a more satisfactory homogenization of the stream 16 which is being built in the path portion Z. Furthermore, the width of the perforated or air-permeable portion of the bottom wall 7 increases in a direction from the upstream end toward the downstream end of the first path portion Z (see FIG. 3) so as to ensure a gradual accumulation of fibrous material across the full or nearly full width of the lower reach 2a.

The distribution of suction ports 18 as shown in FIG. 3 constitutes but one possible mode of attracting fibrous material to the lower reach 2a in the first portion Z of the elongated path. For example, the structure which is shown in FIG. 3 can be modified in such a way that the width of the bottom wall portion which registers with the central or median section M of the lower reach 2a decreases in the direction of the arrow 12 but the width of perforated portions which are adjacent the lateral sections S increases in the direction of such arrow. All that counts is to ensure that the conveyor 2 cooperates with the channel-shaped member 6 and with the suction chambers 9, 17 in the bottom wall 7 in such a way that the apparatus can build a homogeneous stream 16 which contains a certain amount of surplus (16*a*) and can be converted into a superior filler 16, namely a filler at least a portion of the cross-sectional outline of which is determined by the deforming or shaping means forming part of or cooperating with at least one of the units 1, 13 and 19.

It is important and desirable to ensure that the fibers which are attracted to the median section M of the lower reach 2*a* are not intercepted during travel along the lateral sections S so that the density of the stream portion which is being built along the median section M is as satisfactory as that of the other portions of the growing and fully grown stream 16. This is the reason that the lateral or additional suction chambers 17 begin downstream of the upstream region Z1 of the stream building zone (portion Z of the elongated path). The failure of the transporting unit 1 to properly pack fibrous material along the median section M of the lower reach 2*a* could result in the development of cavities which would adversely affect the quality of the ultimate products. Moreover, the presence of cavities would be detected by the customary density monitoring device or devices which are used in cigarette rod making and like machines and serve to initiate expulsion of the corresponding (defective) rod-shaped articles of unit length or multiple unit length.

The suction chambers 9 and 17 enable the lower reach 2*a* to attract fibrous material all the way between its two longitudinally extending marginal portions (see FIGS. 2C and 2D) so as to form a stream 16 which is homogeneous and can be converted into a highly satisfactory filler 116 as a result of removal of the surplus 16*a* in that (second) portion of the elongated path which is adjacent the trimming or equalizing unit 19.

The aforediscussed deformation of the lower reach 2*a* by the bottom wall 7 of the channel-shaped member 6 ensures that the cross-sectional outline of the upper portion of the stream 16 and of the corresponding portion of the filler 116 matches or at least approximates the desired or optimum outline. This entails a reduction of friction and a reduction of the likelihood of malfunction of the wrapping mechanism 22 (also called sizing part) wherein the web 23 of cigarette paper or other suitable wrapping material is draped around the filler 116 to form therewith a continuous cigarette rod which is ready to be subdivided into plain cigarettes of unit length or multiple unit length by a customary cutoff, not shown.

The just discussed configuration of the lower reach 2*a* of the belt conveyor 2 further reduces the likelihood of pronounced friction between the stream 16 and the sidewalls 6*a* of the channel-shaped member 6. This will be readily appreciated since the quantity of fibrous material in the untrimmed stream 16 need not appreciably exceed the quantity of material in the filler 116 because the upper half of the stream 16 is shaped or deformed by the lower reach 2*a* so that its outline corresponds to the desired or optimum shape of the upper part of the filler in the finished product (cigarette rod).

Referring again to FIG. 3, the combined cross-sectional area of suction ports 18 per unit area of the section M in the region Z2 of the portion Z and downstream of suction portion is smaller than the combined cross-sectional area of suction ports 18 per unit area of the section M in the upstream region Z1. This is often desirable and advantageous because it entails a reduction of suction in the median section M downstream of the region Z1. Consequently, relatively large quantities of fibrous material can be attracted to the lateral sections S of the lower reach 2*a* with the resulting formation of a more homogeneous stream 16. Otherwise stated, a substantial quantity of fibrous material is caused to adhere to the median section M of the lower reach 2*a* in the region Z1 and a substantial percentage of fibrous material is caused to adhere to the lateral sections S in the (downstream) region Z2 of the first portion Z of the elongated path. Suction along the median section M downstream of the region Z1 need not appreciably exceed that value which is required to properly attract the corresponding portion of the growing and fully grown stream 16 to the lower reach 2*a*.

FIG. 1 shows that the stream discharging end 21 of the belt conveyor 2 is disposed at a level above the location where successive increments of the web 23 of wrapping material (arriving in the direction of the arrow 23*a* from a bobbin or reel, not shown) reach the upper stretch of an endless flexible belt conveyor 24 known as garniture tape which is an element of the wrapping mechanism or sizing part 22. The garniture tape 24 transports the web 23 and the filler 116 into the wrapping mechanism 22 proper, namely below a so-called tongue 26 where the lower reach 2*a* travels around the pulley 3*a* of the conveying unit 1. The configuration of the pulleys 23A and 24A for the web 23 and garniture tape 24 is preferably such that the web 23 is deformed to exhibit a convex underside and a concave upper side conforming to the underside of an ideal filler 116. This, combined with the aforediscussed deformation of the lower reach 2*a*, reduces friction at the inlet of the wrapping mechanism 22 to a relatively small fraction of friction which is generated during entry of a filler (normally having a square or a rectangular cross-sectional outline) into the wrapping mechanism of a rod making machine which does not embody the apparatus of the present invention. Reduction of friction greatly reduces the likelihood of a pile-up of fibrous material at the inlet of the wrapping mechanism and/or undesirable wrinkling or other deformation of the web 23 on its way through the wrapping station. The wrapping mechanism which receives a pre-deformed web and a filler having a cross-sectional outline which largely corresponds or approximates the cross-sectional outline of the filler of the finished cigarette rod must perform only a minute fraction of deforming work which must be carried out in a wrapping mechanism receiving a conventional filler. This entails a pronounced reduction of the likelihood of malfunction and of the production of rejects and/or lengthy stoppages of the rod making machine. The deforming or shaping action upon the stream 16 begins already at the upstream end of the first portion Z of the elongated path, and the lower reach 2*a* of the conveyor 2 can be said to constitute a means which preserves the desirable cross-sectional outline of the upper portion of the trimmed stream or filler 116 between the trimming station (location of the trimming unit 19) and the stream discharging end 21 of the conveyor 2. The utilization of means for deforming the lower reach 2*a* further contributes to the building of a highly satisfactory homogeneous stream 16 because the concave underside of the lower reach 2a does not exhibit or permit the development of pronounced corners or edges which would be less likely to be uniformly filled with fibrous material than the path which is shown in FIGS. 2A–2D. The aforediscussed distribution of suction chambers 9, 17 and the dimensions of such suction chambers also contribute to more satisfactory uniformity of the quality of the stream 16 and of the filler 116 which is obtained as a result of removal of the surplus 16a from the stream.

The surplus removing or trimming unit 19 of FIGS. 1 and 3 comprises two surplus removing rotary severing members in the form of discs 28 disposed at opposite sides of a central vertical symmetry plane N of the path which is defined by the lower reach 2a of the belt conveyor 2. The longitudinal symmetry plane N is shown in FIG. 4. The cutting edges at the peripheries of the severing members 28 touch each other in the plane N to separate the surplus 16a from the remainder of the stream 16. The removed surplus 16a is returned into the distributor which includes the feeding unit 13, for readmission into the path which is defined by the lower reach 2a of the belt conveyor 2.

In accordance with a further feature of the invention, the configuration and/or mounting of the rotary severing members is such that they also contribute to the development of desired cross-sectional outline of the filler 116, namely to the formation of a cross-sectional outline which matches or approximates the desired or optimum outline of the corresponding portion of rod-shaped material which is confined in the web 23 forming part of the finished cigarette rod.

FIG. 4 shows schematically one of the presently preferred trimming units 19. This trimming unit comprises two rotary severing members 28a each of which is a flat disc mounted on a shaft 28A for rotation in the direction indicated by the respective arrow. The angles denote the inclination of the planes of severing members 28a with respect to a horizontal plane which is normal to the symmetry plane N. It will be seen that the severing members 28a impart to the lower portion of the filler 116 a substantially inverted roof-shaped outline which is much closer to the desired or customary convex outline than an outline which is achieved by two severing members rotating in a common plane. The manner in which the severing members 28a are rotated when the rod making machine embodying the trimming unit 19 of FIG. 4 is in actual use is conventional and, therefore, need not be shown in the drawing. Reference may be had to numerous granted U.S. patents which are owned by the assignee and disclose suitable trimming units save for the feature of mounting the trimming units with a view to impart to the filler an outline approximating or matching the desired or optimum outline.

FIG. 5 shows schematically a modified trimming or equalizing unit 19 with two coplanar disc-shaped rotary severing members 28b disposed at opposite sides of the symmetry plane of the path for the stream 16 and rotatable about parallel vertical axes in directions indicated by the arrows. The cutting edges 29 of the severing members 28b contact each other in the symmetry plane and are adjacent to circumferentially complete concave substantially frustoconical shaping surfaces 31 which cooperate with each other to impart to the lower portion of the filler 116 a substantially circular cross-sectional outline which matches or very closely approximates the ideal cross-sectional outline of the material within the confines of the tubular wrapper of a cigarette rod. The surfaces 31 mechanically shape the adjacent portions of the stream 16 during removal of the surplus 16a so as to impart to the filler a desired cross-sectional outline which is even superior to that imparted by the corresponding portions of the disc-shaped rotary severing members 28a shown in FIG. 4. The mechanical work which is performed by the stream shaping surfaces 31 of the rotary severing members 28b shown in FIG. 5 need not be performed by the wrapping mechanism 22 during draping of the resulting filler 116 into a web 23 of cigarette paper or other suitable wrapping material. FIG. 2D shows that, by utilizing the trimming unit 19 of FIG. 5, one ensures that the filler 116 has a cross-sectional outline which very closely resembles that of an ideal rod.

FIG. 6 shows a modification of the trimming unit of FIG. 5. The disc-shaped rotary severing members 28c have stream shaping surfaces 32 which resemble conical frusta without the pronounced concavity of the surfaces 31 which are shown in FIG. 5. The configuration of the lower portion of a filler which is formed by the trimming unit of FIG. 6 may not be as satisfactory as that of the filler which is formed in the unit 19 of FIG. 5 but is much more satisfactory than the configuration of a filler which is obtained in conventional rod making machines wherein the underside of the filler is flat.

The apparatus of the present invention can be used with with conventional trimming units which impart to the underside of the filler a flat shape. In such apparatus, the deforming or shaping work is carried out exclusively or predominantly by the properly deformed lower reach 2a of the belt conveyor 2. Such partial shaping of the filler also contributes to a reduction of friction during travel of the filler and of the web of wrapping material through the wrapping mechanism 22 or through an analogous wrapping mechanism. It has been found that the deforming or shaping action of the belt 2 alone contributes significantly to a reduction of the likelihood of jamming at the wrapping station and to a significant improvement of the quality of the finished rod.

The shaping of the web 23 of wrapping material by its pulley 23A and/or by the garniture tape 24 is optional but desirable and advantageous. The placing of the pulley 23A and of the pulley 24A close to the trimming unit 19 reduces the likelihood of undesirable deformation of the underside of the filler 116 on its way toward the wrapping station, i. e., the filler is less likely to change its cross-sectional outline so that its outline does not depart from that which has been imparted thereto by the trimming unit of FIG. 4, 5 or 6.

German printed patent application No. 25 21 414 already discloses a surplus removing or trimming unit wherein the rotary severing members are disposed at an angle to each other in a manner similar to that shown in FIG. 4. However, the apparatus of the German printed patent application employs substantially cup-shaped surplus removing or severing members and the purpose of the trimming unit is to ensure that the severing members engage only the sides of the advancing stream of fibrous material. This guarantees that the severing members do not alter the configuration of the stream which carries the surplus on its way toward the trimming station. Any profiling or shaping which is achieved by the cupped severing members of the German printed patent application is lost downstream of the material removing station as a result of transfer of the obtained filler onto a flat suction-operated belt conveyor to which the filler is attracted on its way toward the wrapping station. At any rate, the filler which reaches the wrapping mechanism does not exhibit any traces of that shape or cross-sectional outline which is imparted to it by the cupped severing members.

An important advantage of the apparatus which is shown in FIGS. 1 to 3 is that it can be incorporated into existing cigarette rod making machines wherein the stream of fibrous material is built at the underside of an air-permeable belt conveyor. The provision of a channel-shaped member (6) which deforms or shapes the lower reach 2*a* of the belt conveyor 2 contributes little to the cost of the rod making machine but ensures a pronounced reduction of friction at the inlet of the wrapping mechanism. The channel-shaped member 6 enables the conveyor 2 to build a continuous stream 16 which contains a predictable quantity of surplus 16*a* and is more homogeneous than the streams which are formed in conventional apparatus. Shaping of the stream 16 and of the filler 116 ahead of the garniture tape 24 greatly reduces the likelihood of damage to and/or deformation of the web 23 of wrapping material. This will be readily appreciated by bearing in mind that the lower reach 2*a* prevents relatively hard and stiff fragments of tobacco ribs (if any) from projecting beyond the outline of the filler 116 so that such relatively hard fragments are less likely to puncture the web 23 during travel through the wrapping mechanism 22.

FIGS. 1 and 7–9 show the details of a densifying device 33 which can be utilized in the improved apparatus to cyclically densify longitudinally spaced-apart portions of the filler 116. This is desirable in connection with the making of cigarettes having so-called dense ends. The densifying device 33 is located at the material removing station above the trimming unit 19 between two spaced-apart portions of the suction chamber 9. This can be seen in FIGS. 1 and 7. The densifying device 33 comprises a housing 34 for a means which ensures repeated pneumatic densification of the stream 16 at the time the stream is being relieved of the surplus 16*a*. The densified portions remain in the filler 116 to thus ensure that the corresponding portions of the cigarette rod contain more fibrous material than the non-densified portions.

The housing 34 defines a compartment or chamber 35 for a rotary disc-shaped element 36. The peripheral surface of the element 36 is in sealing contact with the surface surrounding the compartment 35. The element 36 is formed with a circumferentially extending groove 37 which is located in a first plane adjacent to a second plane for a radially extending bore 39. The groove 37 is interrupted in a region 38 which is adjacent the radially extending bore 39. The radially innermost portion of the bore 39 communicates with an axially extending bore 41 which is connected to a suction generating device 42. Suction which is generated by the device 42 is more pronounced than the suction which is generated by the device 11 of FIG. 1. For example, suction in the chambers 9 and 17 which are connected with the suction generating device 11 can be in the range of 800 mm water column or 80 mbar. On the other hand, suction in the bores 39, 41 which are connected to the suction generating device 42 can be in the range of 3000 mm water column of 0.3 bar. The suction generating device 42 can constitute a conventional lateral channel compressor or any other machine which can generate the aforediscussed suction.

The portion 8 of the channel-shaped member 6 has several discrete suction chambers 43 which are disposed one behind the other (as considered in the direction of the arrow 12) at the surplus removing station. This can be readily seen in FIG. 9 which shows a total of six suction chambers 43. Each suction chamber 43 communicates with two bores 44 and 44*a* which further communicate with the compartment 35 for the rotary element 36 in the housing 34 of the densifying device 33. The bores 44 are coplanar with the groove 37 in the periphery of the element 36, and the bores 44*a* are coplanar with the radially extending bore 39 of the element 36. A bore 47 connects the upstream portion of the suction chamber 9 with the compartment 35 in the plane of the groove 37, and a bore 47*a* connects the downstream portion of the suction chamber 9 with the compartment 35, again in the plane of the groove 37. The drive means (not shown) for the element 36 operates in synchronism with the drive means (e.g., the pulley 3*a* or the pulley 3*b*) for the belt conveyor 2.

When the element 36 rotates and its groove 37 communicates with the bores 44 of the housing 34, the stream 16 is attracted to the concave underside of the lower reach 2*a* with the same force as during travel along the two portions of the suction chamber 9. This is due to the fact that the portions of the suction chamber 9 communicate with the bores 47 and 47*a* which communicate with the groove 37 during the major part of each revolution of the element 36 and the bores 44 communicate with the suction chambers 43 at the surplus removing station for the unit 19. Suction which is applied to the stream 16 in the region of the trimming unit 19 is interrupted at regular intervals, depending on the speed of the conveyor 2 and the speed of the element 3, whenever the portion 38 of the element 36 reaches the path portion above the severing members 28 of FIGS. 7–9. The portion 38 of the element 36 then seals the bores 44. At the same time, the bore 39 communicates with the bores 44*a* to connect such bores with the suction generating device 42 so that the stream portion below the suction chambers 43 is subjected to a more pronounced pneumatic densifying action. In other words, the suction chambers 43 attract the adjacent portions of the stream 16 with a greater force so that the severing members 28 remove less fibrous material and the corresponding portions of the filler 116 contain larger quantities of fibers. Suction is communicated by the bores 44*a* to successive suction chambers 43 (as considered in the direction of the arrow 12) so that the densification of the corresponding portion of the stream 16 persists during travel past the trimming unit 19. The groove 37 thereupon again reaches the bores 44 so that the pressure in the suction chambers 43 rises to that which is determined by the suction generating device 11. Consequently, the severing members 28 again remove the average or normal quantity of fibrous material so that the densified portions of the filler 116 alternate with less densified portions.

An important advantage of the improved method and apparatus is that the shaping of the stream 16, so as to conform a portion at least of its cross-sectional outline to the desired or optimum outline of the filler 116, begins practically at the very start of the stream building operation and continues at least until after completion of the removal of the surplus 16*a*. The surplus removing unit 19 may but need not always contribute to the shaping of the stream 16 on its way toward the wrapping mechanism 22. Moreover, the aforediscussed distribution of suction chambers 9 and 17 contributes to the formation of a very satisfactory (homogeneous) stream which also enhances the quality of the ultimate product. The distribution of suction ports 18 in a manner as shown in FIG. 3 also contributes to the formation of a homogeneous stream of fibrous material.

The aforediscussed configuration of the lower reach 2*a* and the distribution of suction ports 18 reduce the likelihood of clogging of the channel 6 between the stream building station and the discharge end 21 of the conveyor 2. This will be readily appreciated since the channel- or trough-shaped lower reach 2*a* engages the growing and the fully grown stream not only at the top but also at both sides so that the area of contact between the travelling stream and the stationary sidewalls 6*a* of the channel-shaped member 6 is reduced to a minimum or is eliminated altogether. Accordingly, friction between the travelling stream 16 and filler 116 on the one hand and the sidewalls 6*a* of the channel-shaped member 6 on the other hand can be reduced or eliminated. Consequently, and since the stream 16 and the filler 116 are guided and advanced exclusively or predominantly by the concave underside of the lower reach 2*a*, slippage of the stream relative to the lower reach 2*a* and/or vice versa is practically non-existent. Still further, the absence of friction between the member 6 and the stream 16 reduces the likelihood of dehomogenization of the stream on its way from the first portion Z of the elongated path toward the discharge end 21 of the conveyor 2.

Though the utilization of trimming units of the type shown in FIGS. 4–6 is optional, such trimming units can contribute significantly to the quality of the ultimate product.

German Pat. No. 673,628 to Tögel discloses an air-permeable belt conveyor which is used to transport a tobacco stream in a V-shaped channel. The outer side of the deformed reach of the belt conveyor travels adjacent a suction chamber which attracts the stream to the inner side of the conveyor. The purpose of the suction chamber is to reduce the likelihood of slippage of the conveyor relative to the particles of tobacco which are admitted into the space along the inner side of the conveyor. The patented apparatus exhibits the drawback that the particles of tobacco tend to accumulate along the marginal portions of the conveyor so that the density of the stream portion in the deepmost part of the space at the inner side of the conveyor is much less pronounced than at the open side of the conveyor.

U.S. Pat. No. 3,019,793 to Labbe discloses a cigarette making machine wherein the tobacco stream is caused to advance in a U-shaped portion of an air-permeable conveyor. The machine of this patent exhibits the drawbacks of the apparatus of Tögel.

The cigarette streams which are formed on the air-permeable conveyors of Tögel and Labbe have a cross-sectional outline which can be said to resemble the outline of an ideal tobacco filler more closely than when the stream is built on a flat belt conveyor. However, no advantage is taken of such configuration of the air-permeable conveyors, i.e., the patentees do not point out or stress the advantages of a stream which is formed on an air-permeable belt conveyor having a U-shaped or a V-shaped cross-sectional outline. Moreover, the patents do not disclose that the shape which the stream assumes as a result of travel with a conveyor having a U-shaped or V-shaped cross-sectional outline is preserved, at least in part, all the way to the location where the stream is draped into cigarette paper or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making a continuous filler of fibrous material, particularly a tobacco filler, comprising the steps of feeding fibrous material into a stream-growing portion of an elongated path to build a continuous stream; advancing the stream longitudinally along said path including attracting the fibrous material to one side of an-air permeable endless conveyor and establishing a pressure differential between the one side and the other side of the conveyor so that the fibrous material of the growing and fully grown stream is attracted to and advances with the one side of the conveyor; shaping the stream in the course of at least one of said feeding and advancing steps so as to provide the stream with a predetermined cross-sectional outline, including imparting to the one side of the conveyor the shape of an elongated channel having a longitudinally extending central section and two longitudinally extending lateral sections flanking the central section, said feeding step including attracting fibrous material primarily or exclusively to the central section in a first region of said stream-growing portion of said path and attracting fibrous material to all of the sections in a second region of said stream-growing portion; and preserving at least a portion of the predetermined cross-sectional outline of the stream at least until after completion of said advancing step.

2. The method of claim 1, wherein the shape of the one side of the conveyor is complementary to said portion of the predetermined cross-sectional outline of the stream.

3. The method of claim 1, wherein said feeding step includes feeding fibrous material at a rate such that the continuous stream contains a surplus of fibrous material and said shaping step includes removing the surplus from successive increments of the stream in such a way that the thus trimmed increments of the stream define said portion of the predetermined cross-sectional outline of the stream.

4. The method of claim 1, wherein said shaping step includes mechanically influencing the stream in the course of the surplus removing step.

5. The method of claim 1, further comprising the steps of advancing a continuous web of wrapping material along a second portion of said path downstream of said stream-growing portion, imparting to the web a cross-sectional outline which is complementary to the adjacent portion of the outline of the stream in the second portion of said path, and draping the web around the stream.

6. The method of claim 1, further comprising the step of densifying spaced-apart portions of the stream not later than in the course of said shaping step.

7. Apparatus for making a continuous filler of fibrous material, particularly a tobacco filler, comprising a conveying unit defining an elongated path; a feeding unit for admitting fibrous material into a predetermined portion of said path so as to build on the conveying unit a continuous stream which advances longitudinally along said path, said conveying unit including an endless air-permeable conveyor having a first side defining said path and a second side opposite said first side, said conveyor including a median section and two lateral sections flanking said median section, said conveying unit further comprising first means for reducing the pressure at the second side of said conveyor along said median section of the conveyor in a predetermined region of said predetermined portion of said path so as to attract fibrous material solely or exclusively to said median section and second means for reducing the pressure at the second side of said conveyor along said median section as well as along said lateral sections in a second region of said predetermined portion of said path downstream of said predetermined region so as to attract fibrous material to all of said sections; and shaping means provided in the region of at least one of said units and having means for providing the stream with a predetermined cross-sectional outline.

8. The apparatus of claim 7, wherein said conveying unit has a stream discharging end and further comprising means for preserving at least a portion of the predetermined cross-sectional outline of the stream intermediate said shaping means and said stream discharging end.

9. The apparatus of claim 8, wherein said shaping means is disposed in the region of said conveying unit.

10. The apparatus of claim 7, wherein said shaping means forms part of at least one of said units.

11. The apparatus of claim 7, wherein said shaping means includes said conveyor and said conveyor is deformable, said shaping means further comprising means for deforming said conveyor so as to impart to the conveyor an outline complementary to at least a portion of the predetermined cross-sectional outline of the stream.

12. The apparatus of claim 11, wherein said deforming means is adjacent the predetermined portion of said path.

13. The apparatus of claim 11, wherein said deforming means includes a substantially channel-shaped member having a concave guide surface and said pressure reducing means includes at least one suction chamber in said surface, said conveyor including an endless belt having an elongated reach with a convex side adjacent said guide surface and a concave side adjacent said path.

14. The apparatus of claim 13, wherein said reach of said belt has said median section and said lateral sections, said suction chamber including a first portion disposed in said predetermined region of the predetermined portion of said path adjacent the median section of said reach and a second portion disposed in said second region downstream of said predetermined region and adjacent the median and lateral sections of said reach.

15. The apparatus of claim 14, wherein the second portion of said suction chamber is arranged to increase the pressure differential between the opposite sides of said lateral sections in the direction of travel of the stream from said predetermined region of the predetermined portion of said path.

16. The apparatus of claim 7, wherein said first pressure reducing means comprises pneumatic means for attracting fibrous material to said median section with a greater first force in said predetermined region of the predetermined portion of said path and said second pressure reducing means comprises pneumatic means for attracting fibrous material to said median section with a lesser second force downstream of said predetermined region and for attracting fibrous material to said lateral sections with an increasing force downstream of said predetermined region.

17. The apparatus of claim 7, wherein said pressure reducing means include a suction chamber arranged to attract fibrous material to said median section with a first firce in said predetermined region of the predetermined portion of said path and with a decreasing second force downstream of said predetermined region.

18. The apparatus of claim 16, wherein said shaping means includes a portion forming part of said trimming unit.

19. The apparatus of claim 7, wherein said feeding unit includes means for admitting fibrous material at a rate such that the continuous stream contains a surplus of fibrous material, and further comprising a trimming unit having means for removing the surplus from the stream in a second portion of said path, said removing means of said trimming unit comprising at least one severing member arranged to remove the surplus from a predetermined side of the stream to thus impart to said side a predetermined outline.

20. The apparatus of claim 19, wherein said path has a central longitudinal symmetry plane and said trimming unit has two rotary severing members which are disposed at opposite sides of and make predetermined angles with said symmetry plane.

21. The apparatus of claim 19, wherein said trimming unit has two rotary severing members each including a circumferentially extending cutting edge and a stream shaping surface adjacent said cutting edge.

22. The apparatus of claim 21, wherein each of said shaping surfaces has a substantially conical outline.

23. The apparatus of claim 7, further comprising means for densifying spaced apart portions of the stream.

24. The apparatus of claim 23, wherein said densifying means is adjacent a second portion of said path.

25. A method of making a continuous filler of fibrous material, particularly a tobacco filler, comprising the steps of feeding fibrous material into a stream-growing first portion of an elongated path to build a continuous stream which contains a surplus of fibrous material; advancing the stream longitudinally along said path; removing the surplus from the stream in a second portion of said path; shaping the stream in the course of at least one of said feeding, advancing and removing steps so as to provide the stream with a predetermined cross-sectional outline; and preserving at least a portion of the cross-sectional outline of the stream at least until after completion of said removing step, said shaping step including removing the surplus from successive increments of the stream in such a way that the thus trimmed increments of the stream define said portion of the cross-sectional outline of the stream.

26. Apparatus for making a continuous filler of fibrous material, particularly a tobacco filler, comprising a conveying unit defining an elongated path; a feeding unit for admitting fibrous material into a first portion of said path so as to build on the conveying unit a continuous stream which contains a surplus of fibrous material and advances longitudinally along said path; a trimming unit for removing the surplus from the advancing stream in a second portion of said path; and shaping means provided in the region of at least one of said units and having means for providing the stream with a predetermined cross-sectional outline, said shaping means including a portion forming part of said trimming unit and said trimming unit comprising at least one severing member arranged to remove the surplus from a predetermined side of the stream and to thus impart to said side an outline matching or resembling a portion of said predetermined outline.

* * * * *